United States Patent [19]

Ripert

[11] Patent Number: 4,877,228

[45] Date of Patent: Oct. 31, 1989

[54] CLAMP FOR FITTING TO A CONVEYOR OF AN AUTOMATIC CABLING MACHINE AND INTENDED TO HOLD ONE OR MORE ELECTRICALLY CONDUCTIVE WIRES

[75] Inventor: Victor L. Ripert, Aix-en-Provence, France

[73] Assignee: Automatisme et Robotique Appliques -A.R.A., La Barque, France

[21] Appl. No.: 224,544

[22] Filed: Jul. 26, 1988

[30] Foreign Application Priority Data

Aug. 7, 1987 [FR] France ..... 87 11392

[51] Int. Cl.[4] ..... C25B 1/00

[52] U.S. Cl. ..... 269/156; 269/254 CS; 269/238; 269/902; 269/903

[58] Field of Search ..... 269/156, 254 CS, 238, 269/462, 903, 56, 257; 279/106-109; 294/99.1, 110.1, 19.2

[56] References Cited

U.S. PATENT DOCUMENTS

| | | | |
|---|---|---|---|
| 2,476,734 | 7/1949 | Jellison | 294/110.1 |
| 3,164,406 | 1/1965 | Barry | 294/110.1 |
| 3,741,517 | 6/1973 | Pogonowski | 269/156 |
| 3,902,727 | 9/1975 | Banyas et al. | 269/238 |
| 4,662,618 | 5/1987 | Willis | 269/156 |
| 4,693,473 | 9/1987 | Miller | 294/19.2 |

FOREIGN PATENT DOCUMENTS

| | | |
|---|---|---|
| 8610436 | 7/1986 | Fed. Rep. of Germany . |
| 2130212 | 11/1972 | France . |

*Primary Examiner*—Robert C. Watson
*Attorney, Agent, or Firm*—Ladas & Parry

[57] ABSTRACT

A clamp for fitting to a conveyor in an automatic cabling machine, said clamp comprising two pairs of jaws which are symmetrical about a plane and which are separated by an intermediate space containing a piston which is urged out from the clamp by a spring and whose outer face includes a flared notch.

11 Claims, 3 Drawing Sheets

Fig. 1
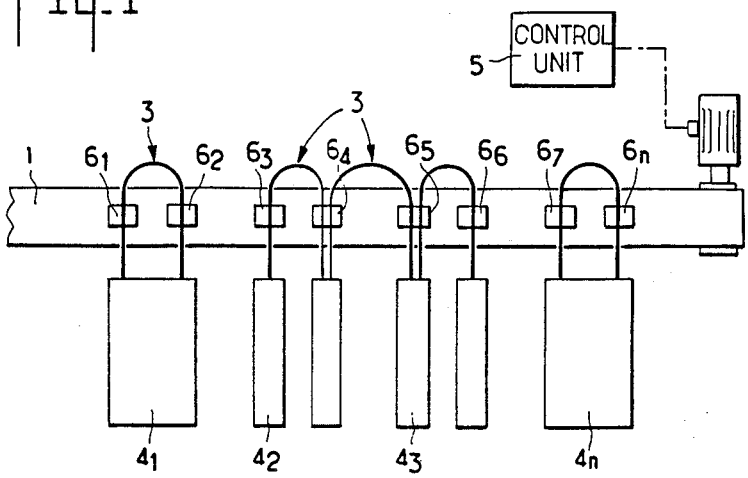
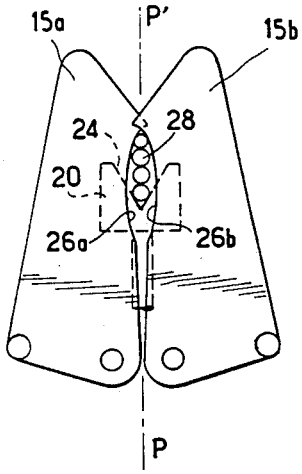
Fig. 7
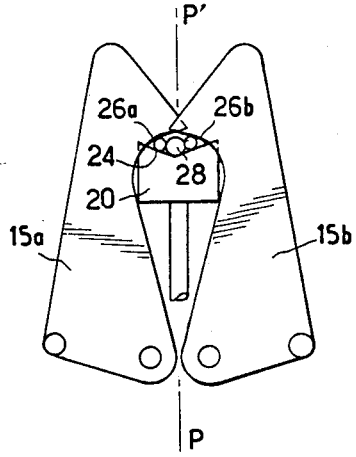
Fig. 8

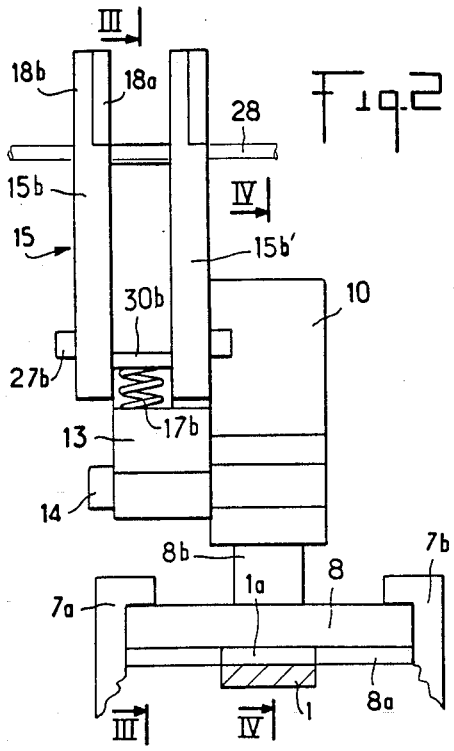
Fig. 2
Fig. 4
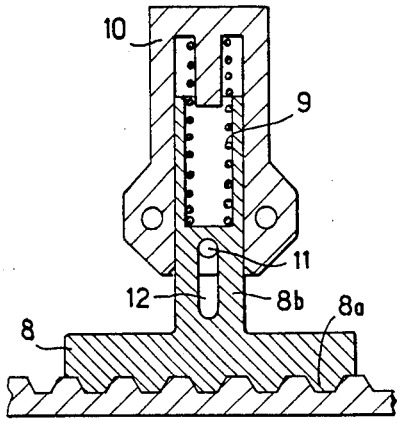
Fig. 3
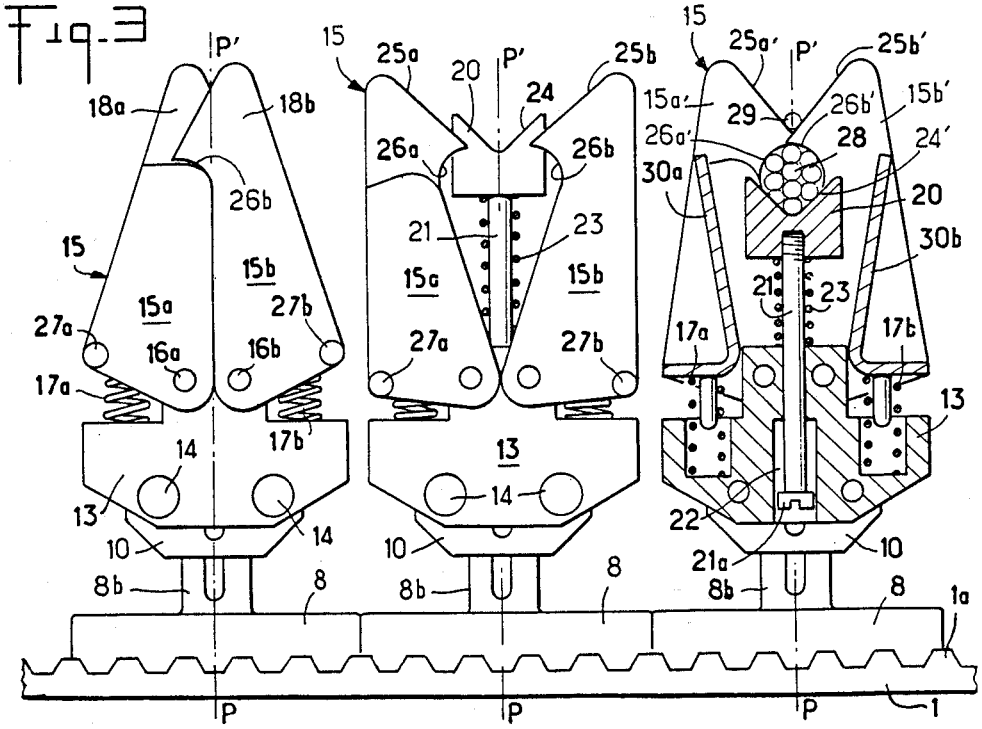

CLAMP FOR FITTING TO A CONVEYOR OF AN AUTOMATIC CABLING MACHINE AND INTENDED TO HOLD ONE OR MORE ELECTRICALLY CONDUCTIVE WIRES

The present invention relates to clamps for fitting to the conveyors of automatic cabling machines.

The technical field of the invention is building automatic cabling machines.

BACKGROUND OF THE INVENTION

Automatic cabling machines are known which are fitted with microprocessors and which automatically cut up wire into various predetermined lengths, which strip the ends of the wires and which crimp terminals in the form of a connector portions to the stripped ends. These machines include one or more circular or linear conveyors which carry means for holding the lengths of wire, which lengths are presented to various work stations distributed along the conveyor.

In some applications it is necessary to provide cabling machines which are capable of performing multiple crimping, i.e. of crimping a single terminal onto a plurality of conductive wires simultaneously. The problem to be solved is providing clamps capable of encompassing one or more wires and of receiving new wires without running the risk of releasing wires already held. Further, it is also necessary to provide mechanical means for inserting the wires into the clamps and for extracting them easily.

SUMMARY OF THE INVENTION

This problem is solved by the present invention which provides a clamp for fitting to a conveyor in an automatic cabling machine for the purpose of holding one or more electrically conductive wires, the clamp comprising two pairs of jaws hinged to a fixed base, each of said pairs comprising two jaws which are symmetrical about a plane of symmetry and which are fitted with return means for urging them automatically towards a closed position, said pairs being spaced apart by an intermediate space, and said clamp further including a central piston which is situated in said intermediate space, which is symmetrical about said plane of symmetry, and which is fitted with return means for urging it automatically towards the free ends of said jaws.

Advantageously, the outer face of said piston includes a V-shaped notch which is symmetrical about said midplane and which is outwardly flared.

The free end of the inside edge of each of said jaws includes a slope which is inclined downwardly and inwardly. In addition, the inside edge of each of said clamps includes a concave notch situated beneath the bottom end of said slope and delimiting in conjunction with the flared notch in the outer face of said piston, a passage of variable section in which one or more electrically conductive wires may be held.

The invention also provides a device for inserting wires in a clamp in accordance with the invention, said device comprising two pairs of jaws which are actuated by an actuator and which are spaced further apart than the overall width of said clamp.

The result of the invention is to provide new clamps suitable for fitting to automatic cabling machine conveyors, which clamps are intended to hold one or more conductive wires for the purpose of presenting the ends thereof to work stations distributed along the conveyors.

An advantage of a clamp in accordance with the invention lies in the fact that it can receive one or several conductive wires and that a new wire can be inserted without the clamp releasing the other wire(s).

Another advantage of a clamp in accordance with the invention lies in the fact that, regardless of the number of conductive wires clamped therein, the wires are held together in the form of a bundle whose cross-section may be generally circular or flattened in shape, thereby making it possible to crimp a terminal on a plurality of wires simultaneously.

Another advantage of a clamp in accordance with the invention lies in the fact that mechanical insertion of wires into the clamp is facilitated and may be performed merely by presenting the wire over the clamp, and then pressing downwards, such that the wire itself causes the jaws of the clamp to open.

Another advantage of a clamp in accordance with the invention lies in the fact that the wires can be ejected from the clamp simply by pressing against the jaws of the clamp in order to open them, thereby causing the piston incorporated in the clamp to eject the wires.

BRIEF DESCRIPTION OF THE DRAWINGS

Embodiments of the invention are described by way of example with reference to the accompanying drawings, in which:

FIG. 1 is a plan diagrammatic overall view of a conveyor portion of an automatic cabling machine;

FIG. 2 is an end view, partly in cross section, of another portion of the machine of FIG. 1;

FIG. 3 is a front view, partly in section on III—III of FIG. 2, of another portion of the machine showing a plurality of successive clamps in different positions;

FIG. 4 is a front view, in section on IV—IV of FIG. 2, of another portion of the machine;

FIG. 5 is a front elevation of a device for inserting wires into a clamp in accordance with the invention;

FIG. 6 is a front elevation partly in section, of the device of FIG. 5 when in an open position; and FIGS. 7 and 8 are fragmentary front views of two variant embodiments of a clamp in accordance with the invention.

MORE DETAILED DESCRIPTION

FIG. 1 diagrammatically shows an automatic cabling machine having a conveyor 1 constituted, for example, by a notched endless belt driven by a stepper motor. The conveyor 1 has vices or clamps $\mathbf{6}_1$ to $\mathbf{6}_n$ to displace lengths of conductive wire 3 past a plurality of work stations $\mathbf{4}_1$, $\mathbf{4}_2$, . . . $\mathbf{4}_n$ situated along the conveyor 1, to one side thereof.

These work stations may comprise, for example, a station for stripping the ends of the conductive wires, another station for threading heat shrink insulating sleeves over the stripped ends, another station for crimping terminals to the stripped ends, another station for pulling the insulating sleeve back over the terminal, etc.

The movements of the conveyor and of the work stations are controlled in synchronism by a central control unit 5 fitted with a microprocessor.

Other automatic cabling machines of this type, fitted with linear or turntable conveyors carrying vices, each of which clamps onto a wire, are known and, therefore, the machine of FIG. 1 need not be further described.

These machines are capable of automatically preparing predetermined sets of wires in which each wire is of determined length and is fitted with a determined terminal.

However, existing machines are not designed to be able to perform multi-wire crimping mechanically, i.e. to crimp a single terminal onto a plurality of conductive wires.

The clamps $6_1$ to $6_n$ in accordance with the invention, however, are capable of holding either a single wire, e.g. clamps $6_1$, $6_2$, $6_3$, $6_6$, and $6_7$, or else a plurality of wires, e.g. clamps $6_4$, $6_5$.

FIG. 2 shows the top run of conveyor 1, which is endless and constituted by a cog belt. This conveyor is located in a slideway formed by two bars 7a and 7b (not shown in diagrammatic FIG. 1) situated on either side of the conveyor and extending parallel thereto. Supports 8 (not shown in diagrammatic FIG. 1) are engaged in the slideway. The bottom faces of the supports 8 include ribs 8a delimiting grooves, and engaging in the cogs of the cog belt 1 such that the supports 8 are entrained by the movement of the cog belt without sliding while sliding relative to the slideway 7a, 7b which serves to guide them.

Each support 8 includes a hollow upright 8b which may be round or polygonal in section and in which a spring 9 (FIG. 4) is placed and on which a cap 10 is engaged which is urged upwardly by the spring 9. (FIG. 4 shows an example in which the upright 8b is circular in section and a pin 11 is engaged in an oblong slot 12 through the upright in order to prevent the cap from rotating while leaving it free to move vertically.) Each cap 10 carries a clamp 15 , i.e. one of the clamps $6_1$ to $6_n$ of FIG. 1. As shown in FIG. 2 and/or 3, each clamp 15 comprises a base 13 fixed to it cap 10 by two screws 14 (or by any other equivalent fixing means). Each clamp is symmetrical about a plane PP' extending perpendicularly to the plane of FIG. 3 and to the longitudinal axis of the conveyor. Each clamp comprises two pairs of jaws (FIG. 2) constituting two elementary clamps. Each elementary clamp comprises one of the two pairs of jaws 15a and 15b, e.g. in FIG. 3, which are symmetrical in shape about the plane PP'. The elementary clamps are the same and, therefore, only one is described, principally, and corresponding references characters, primed, are used where description of the other is needed.

Each of the jaws is hinged at one end to the base 13 about a hinge axis 16a or 16b. Each jaw is fitted with a return spring 17a or 17b (or with any other equivalent return means) for exerting a couple on said jaw tending to cause it to pivot about its hinge axis 16a or 16b in the clamp-closing direction.

In FIG. 2 it can be seen that the two elementary clamps are separated by an intermediate space 19. FIGS. 2 and 3 also show that the two jaws 15a and 15b of each pair have the same thickness and are situated in the same longitudinal plane, except for their opposite free ends 18a and 18b which are each equal to one half of the thickness of the remainder of the jaws and which are offset sideways so that they overlap when the two jaws are in the closed position.

In addition, each jaw includes a central piston 20 (only two shown in FIG. 3) which is situated in the intermediate space 19 between the two elementary clamps.

The piston 20 is symmetrical about the plane PP'. It is mounted on a rod 21 which includes a head 21a sliding in a bore 22 in the base 13 and coming into abutment against the top end of said bore. The piston 20 is equipped with a return spring 23 or with any other appropriate return means urging the piston towards the free ends of the jaws of the clamp, i.e. upwardly as shown in FIG. 3.

The outer face of the piston 20 includes a V-shaped notch 24 which is symmetrical about the plane PP'.

The inside edge of the free end of each jaw includes a slope 25a or 25b which slopes downwardly towards the inside of the clamp, i.e. towards the plane of symmetry PP'. The slopes 25a and 25b of the two jaws in each pair are symmetrical about the plane PP' and thus form an outwardly flared V-shape similar to the notch 24 on the outer face of the piston.

In addition, the inside edge of each of the jaws includes, immediately below the bottom or inner end of the slope 25a or 25b, a notch 26a or 26b whose concave surface faces inwardly.

Each of the jaws includes an outwardly projecting lug 27a or 27b which is disposed in such a manner that by pressing simultaneously on all four lugs, a couple is exerted on the jaws tending to move them apart, thereby opening the two elementary clamps and causing any wires therein to be ejected by the central piston 20 which is urged upwardly.

FIG. 3 shows three different positions for a clamp in accordance with the invention.

The leftmost view shows the clamp in a completely closed position and containing no wire. The free ends 18a and 18b of the two jaws of each elementary clamp overlap in pairs. The piston 20 is held in place by the pairs of jaws since the jaw return springs exert a stronger closing couple than the opening couple provided by the return spring 23 of the piston.

The righthand view is a section on a longitudinal plane through a clamp in a position in which it is holding a plurality of wires 28'.

It can clearly be seen from this view that the two notches 26a' and 26b' and the V-shaped notch 24' of the piston delimit a passage having a rounded cross-section which is close to being circular and which is variable as a function of the relative positions of the two jaws and piston, with the wires 28' being held between the two jaws and piston which serve to hold them together which is the desired effect in order to be able to crimp a single terminal onto the ends of a plurality of wires simultaneously, which wires need to be kept in close contact.

This figure also shows a new wire 29 being presented between the jaws of the clamp by having a downwards force exerted thereon, and as a result said new wire presses against the slopes 25a' and 25b' and exerts a couple on the jaws tending to move them away from each other until the new wire passes between the tips of the two jaws and joins the bundle of wires 28' already held by the clamp. While a new wire is being inserted, the bundle of wires 28' already in place in the clamp continues to be held in place by the combined action of the two jaws and of the piston 20 and none of the wires can escape from the clamp.

The middle view of FIG. 3 shows a clamp which has been opened by exerting a force vertically on the projecting lugs 27a and 27b using an actuator or any other equivalent pusher. The jaws 15a and 15b are moved apart and the piston 20 ejects the wires from the clamp under thrust from the spring 21.

It can be seen in the righthand view that the two elementary clamps are connected to each other by two spacers in the form of two curved plates 30*a* and 30*b* against which the return springs 17*a* and 17*b* exert their thrust.

FIG. 5 is an elevation view of a device for mechanically inserting wires into clamps in accordance with the invention.

This figure shows a clamp 15 mounted on a base 13 and constituted by two identical elementary clamps each of which comprises two jaws 15*a* and 15*b*, as before.

The wire-insertion device comprises an actuator 31 whose rod actuates two identical clamps each constituted by a pair of jaws 32*a* and 32*b* which two clamps are further apart than the overall width of the clamps 15 so that when the actuator 31 moves its two pairs of jaws 32*a* and 32*b* downwards, they lie on either side of the two elementary clamps constituting the clamp 15.

A wire 29 is clamped between two pairs of jaws 32*a* and 32*b*.

The downwards displacement of the actuator 31 presses the wire 29 against the two inclined slopes 25*a* and 25*b*, thereby moving the jaws 15*a* and 15*b* apart and inserting the wire 29 in the clamp 15. The actuator 31 then opens its jaws 32*a* and 32*b* and raises them.

FIG. 6 is a vertical section through a FIG. 5 device for inserting wires shown in the position where its jaws 32*a* and 32*b* are open.

The device shown in FIGS. 5 and 6 can successively insert a plurality of same diameter or different diameter wires into a single clamp.

FIG. 3 shows an embodiment in which the notch 24 on the piston 20 and the notches 26*a*, 26*b* in the jaws are shaped so that together they delimit a substantially circular passage.

Other shapes could be provided.

FIG. 8 shows an example in which the notch 24 of piston 20 has a very wide aperture angle and the notches 26*a* and 26*b* are highly curved, thereby causing the wires 28 to occupy a bundle which is flattened in a direction perpendicular to the plane of symmetry PP'.

It is also possible to associate a piston 20 having a very narrow notch 24 with notches 26*a* and 26*b* which are only slightly concave in order to bring the wires 28 together in the form of a flat bundle situated in the plane of symmetry PP', as shown in FIG. 7.

It is mentioned above that the support 8, 10 which connects each clamp to the conveyor 1 includes a cap 10 placed over an upright 8*b* which is urged upwardly by a spring 9.

By pressing vertically on the top of the cap 10 by means of a pusher, the clamp can be displaced vertically, thereby lowering the wires into a crimping tool or plunging the ends of the wires into a tinning bath.

I claim:

1. A clamp for fitting to a conveyor in an automatic cabling machine for the purpose of holding one or more electrically conductive wires, the clamp comprising two pairs of jaws hinged to a fixed base, each of said pairs comprising two jaws which are symmetrical about a plane of symmetry and which are fitted with return means for urging them automatically towards a closed position, said pairs being spaced apart by an intermediate space, and said clamp further including a central piston which is situated in said intermediate space, which is symmetrical about said plane of symmetry, and which is fitted with return means for urging it automatically towards the free ends of said jaws.

2. A clamp for fitting out an automatic cabling machine conveyor for holding one or more electrical wires, the clamp comprising a base mounted on a conveyor having a longitudinal axis and two pairs of jaws hinged at one end of each jaw to said base, each pair of said jaws comprising two jaws situated in a plane perpendicular to said conveyor and parallel to said longitudinal axis of said conveyor, said two jaws being symmetrical about a transverse plane perpendicular to said longitudinal axis of said conveyor and fitted with return means for urging them automatically towards a closed position, said two pairs of jaws being spaced apart by an intermediate space and said clamp further comprising a central piston situated in said intermediate space and fitted with return means for urging it automatically towards opposite, free ends of said jaws.

3. A clamp according to claim 2, wherein the outer face of said piston includes a V-shaped notch which is symmetrical about said plane of symmetry and which is outwardly flared.

4. A device for inserting wires into a clamp according to claim 2, the device comprising two pairs of jaws which are actuated by an actuator and which are spaced further apart than the overall width of said clamp.

5. A clamp for fitting out an automatic cabling machine conveyor for holding one or more electric wires to be displaced by said conveyor, the clamp comprising a base mounted on a conveyor having a longitudinal axis and two pairs of jaws hinged at one end of each jaw to said base, each pair of said jaws comprising two jaws situated in a plane perpendicular to said conveyor and parallel to said longitudinal axis of said conveyor, said two jaws being symmetrical about a transverse plane perpendicular to said longitudinal axis of said conveyor and fitted with return means for urging them automatically towards a closed position, said two pairs of jaws being spaced apart by an intermediate space and said clamp further comprising a central piston situated in said intermediate space, fitted with return means for urging it automatically towards opposite, free ends of said jaws, and having an outer face that includes a V-shaped notch which is symmetrical about said transverse plane of symmetry, an inside edge of the free end of each jaw having a slope which is inclined inwardly towards said transverse plane of symmetry for forming an outwardly flared V shape so that, when a wire is pressed against said slopes, said jaws are moved away from each and said closed position.

6. A clamp according to claim 5, wherein the inside edge of each of said clamps includes a concave notch situated beneath the bottom end of said slope and delimiting in conjunction with the flared notch in the outer face of said piston, a passage of variable section in which one or more electrically conductive wires may be held.

7. A clamp according to claim 5, wherein each of the jaws include a projecting lug enabling said jaws to be moved apart by pressing against said lugs, thereby causing the wires contained in a clamp to be ejected.

8. A clamp according to claim 6, wherein said flared piston notch and said concave jaw notches are shaped so as to delimit a passage which is generally circular in shape.

9. A clamp according to claim 8, wherein said piston notch is widely flared and said jaw notches are highly curved, thereby delimiting a passage which is elongate in a direction perpendicular to said plane of symmetry, enabling a plurality of wires to be brought together side-by-side in order to form a flat bundle.

10. A clamp according to claim 8, wherein said piston notch has a small aperture angle and said jaw notches are only slightly curved, thereby delimiting a passage which is elongate in the plane of symmetry, enabling a plurality of wires to be brought together side-by-side in order to form a flat bundle.

11. A clamp according to claim 5, mounted on a conveyor by means of a support capable of being displaced vertically by a vertical pusher, thereby enabling the lengths of wire held by the clamp to be displaced vertically.

* * * * *